US008983310B2

(12) United States Patent
Kanehara

(10) Patent No.: US 8,983,310 B2
(45) Date of Patent: Mar. 17, 2015

(54) IMAGE FORMING APPARATUS

(71) Applicant: Brother Kogyo Kabushiki Kaisha, Nagoya-shi, Aichi-ken (JP)

(72) Inventor: Kohei Kanehara, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 38 days.

(21) Appl. No.: 13/718,569

(22) Filed: Dec. 18, 2012

(65) Prior Publication Data

US 2013/0195471 A1 Aug. 1, 2013

(30) Foreign Application Priority Data

Jan. 31, 2012 (JP) ..... 2012-018197

(51) Int. Cl.
*G03G 15/00* (2006.01)
*G03G 15/02* (2006.01)
*G03G 21/18* (2006.01)

(52) U.S. Cl.
CPC ..... *G03G 15/0266* (2013.01); *G03G 15/0283* (2013.01); *G03G 21/1875* (2013.01)
USPC ..... 399/13; 399/12; 399/50

(58) Field of Classification Search
CPC ..... G03G 15/0291; G03G 21/1896; G03G 21/1871; G03G 21/1875; G03G 21/1867
USPC ..... 399/13, 25, 34, 50, 170, 171–176
See application file for complete search history.

(56) References Cited

U.S. PATENT DOCUMENTS

| | | | | |
|---|---|---|---|---|
| 6,311,030 | B1 * | 10/2001 | Terada | 399/90 |
| 8,781,350 | B2 * | 7/2014 | Kondo et al. | 399/50 |
| 2006/0024074 | A1 | 2/2006 | Maeda et al. | |
| 2007/0189782 | A1 * | 8/2007 | Able et al. | 399/13 |
| 2010/0080593 | A1 | 4/2010 | Inukai et al. | |
| 2010/0196043 | A1 * | 8/2010 | Hamaya | 399/88 |
| 2012/0027436 | A1 | 2/2012 | Maruyama et al. | |

FOREIGN PATENT DOCUMENTS

| | | | |
|---|---|---|---|
| JP | H03-142483 | A | 6/1991 |
| JP | 2006-047490 | A | 2/2006 |
| JP | 2010-102289 | A | 5/2010 |
| JP | 2012-032531 | A | 2/2012 |

* cited by examiner

*Primary Examiner* — Clayton E LaBalle
*Assistant Examiner* — Ruifeng Pu
(74) *Attorney, Agent, or Firm* — Merchant & Gould PC

(57) ABSTRACT

An image forming apparatus, comprising: a charge voltage application circuit configured to be connected to a plurality of chargers in a process cartridge and to apply a voltage to the plurality of chargers; a current detection unit configured to detect a current flowing through each of the plurality of chargers; and a controller. The controller judges that the process cartridge is not attached to the image forming apparatus when the current smaller than a first threshold is detected by the current detection unit in a state where the charge voltage application circuit generates a predetermined voltage.

8 Claims, 11 Drawing Sheets

IMAGE FORMING APPARATUS

CROSS-REFERENCE TO RELATED APPLICATION

This application claims priority under 35 U.S.C. §119 from Japanese Patent Application No. 2012-018197, filed on Jan. 31, 2012. The entire subject matter of the application is incorporated herein by reference.

BACKGROUND

1. Technical Field

Aspects of the present invention relate to an image forming apparatus.

2. Related Art

A multicolor image forming apparatus provided with chargers the number of which is equal to the number of colors of developer (e.g., yellow, magenta, cyan and black) is known. One of such image forming apparatuses is configured to reduce the number of components and to downsize by sharing a high-voltage power supply which applies a high voltage to each charger.

SUMMARY

In order to suppress decrease of image quality, it is preferable that a current flowing through each charger is controlled to be a target value. However, when the high-voltage power supply is shared as described above, it becomes impossible to individually adjust voltage levels to be applied to the respective chargers. In such a case, a designer may try to control voltage levels to be applied to the chargers so that a current flowing through a selected one of the chargers becomes a target value. However, if a process cartridge including a control target charger is not attached to the image forming apparatus, the current does not change even when control of voltage levels to be applied to the charger is performed. As a result, a possibility arises that a failure of the high-voltage power supply occurs due to a fact that an excessively high voltage level is applied to the chargers. In view of the circumstances, the image forming apparatus is required to be able to judge whether the process cartridge is attached thereto.

Aspects of the present invention are advantageous in that they provide an image forming apparatus which is configured to share a voltage supply circuit and is capable of judging whether a process cartridge is attached to the image forming apparatus.

According to an aspect of the invention, there is provided an image forming apparatus, comprising: a charge voltage application circuit configured to be connected to a plurality of chargers in a process cartridge and to apply a voltage to the plurality of chargers; a current detection unit configured to detect a current flowing through each of the plurality of chargers; and a controller. The controller judges that the process cartridge is not attached to the image forming apparatus when the current smaller than a first threshold is detected by the current detection unit in a state where the charge voltage application circuit generates a predetermined voltage.

BRIEF DESCRIPTION OF THE ACCOMPANYING DRAWINGS

Figure 3:
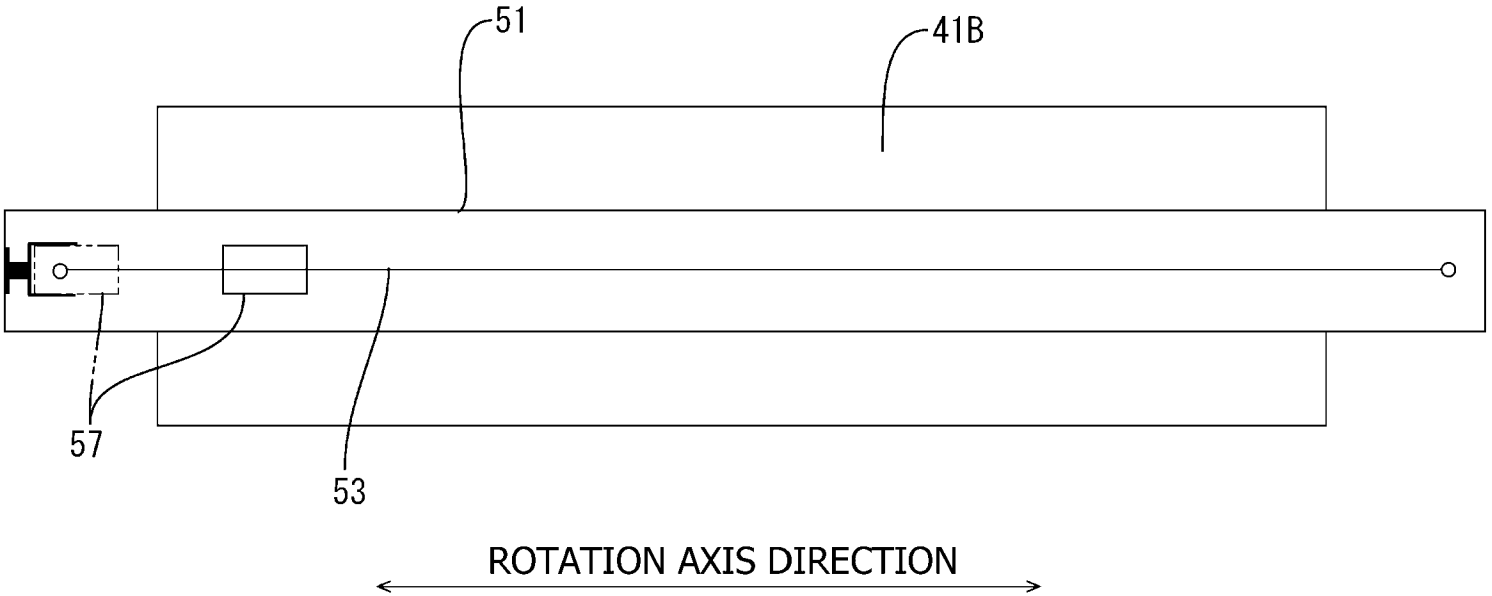

FIG. 3 schematically illustrates a configuration of a charger.

Figure 4:
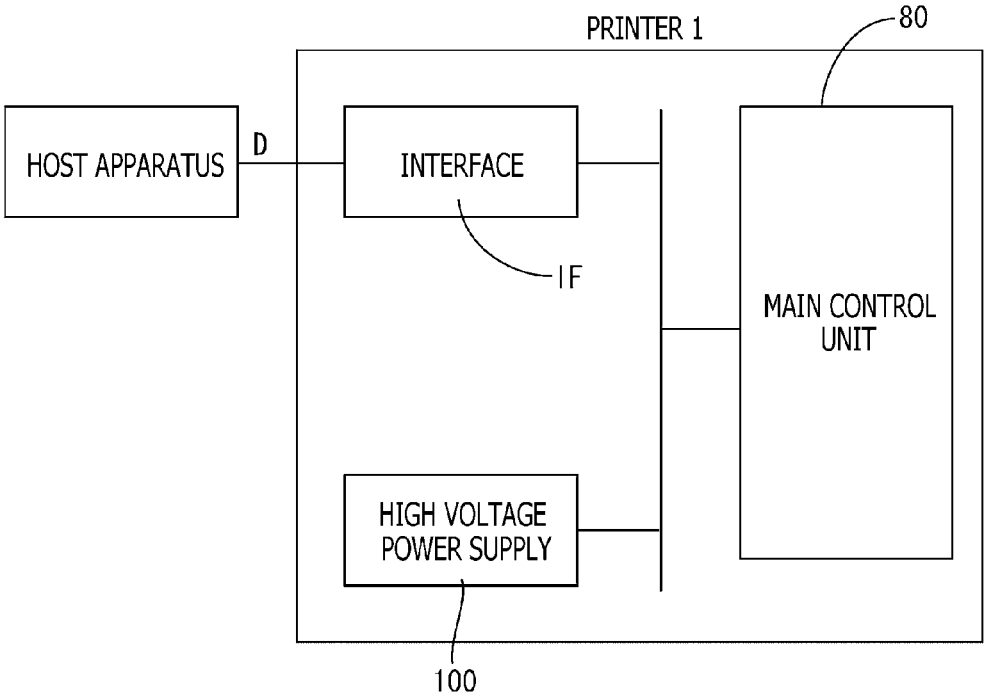

FIG. 4 is a block diagram illustrating an electrical configuration of the printer.

Figure 5:
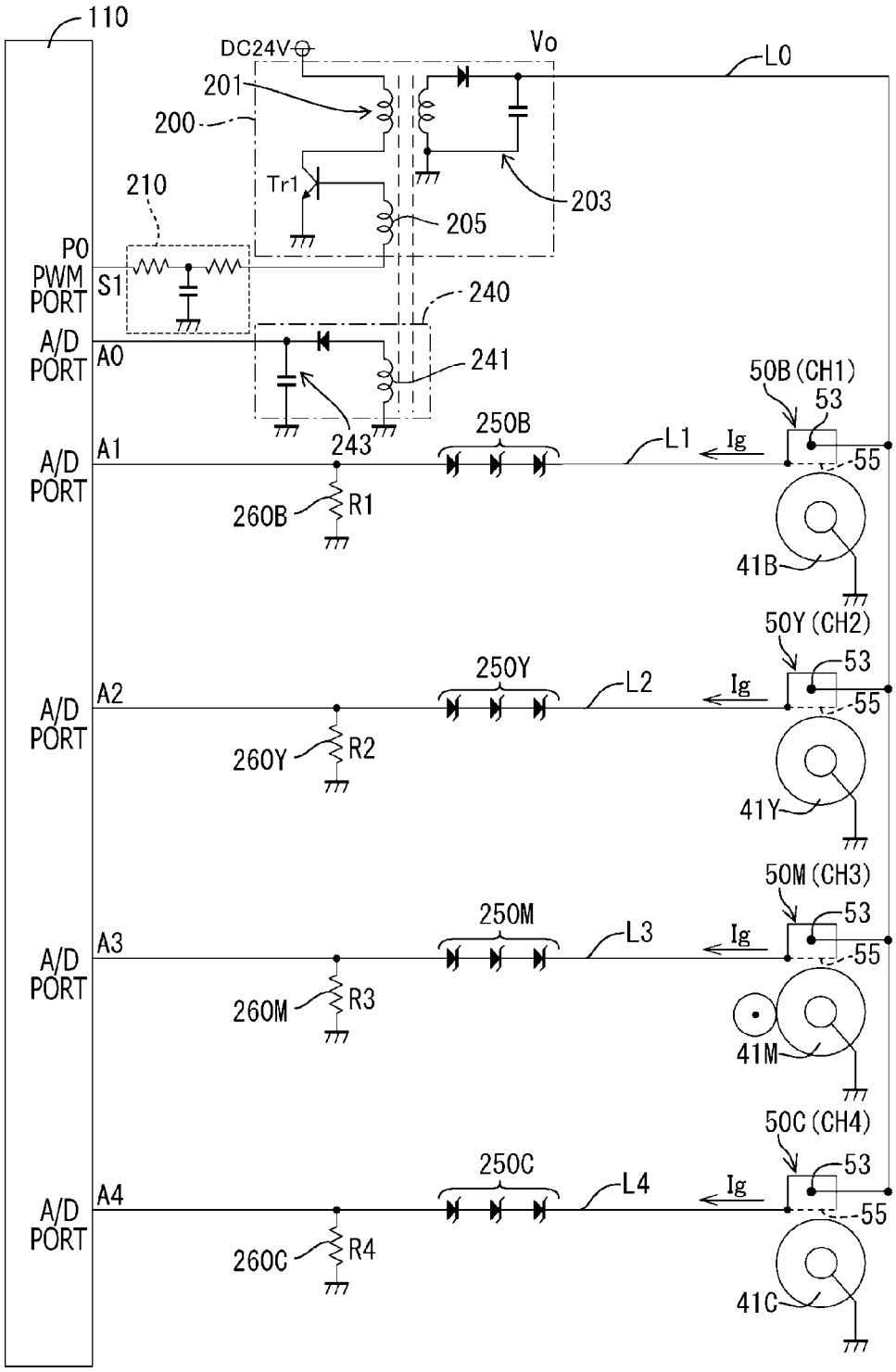

FIG. 5 is a circuit diagram illustrating an electrical configuration of a high voltage power supply.

Figure 6:
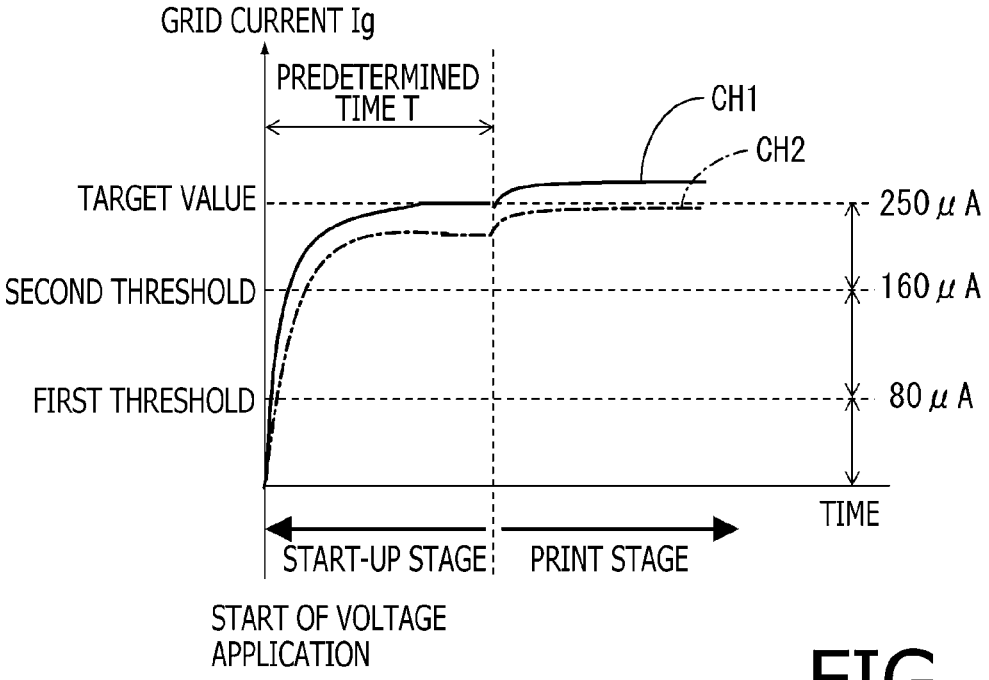

FIG. 6 is a graph illustrating transition of a grid current of each channel.

Figure 7:
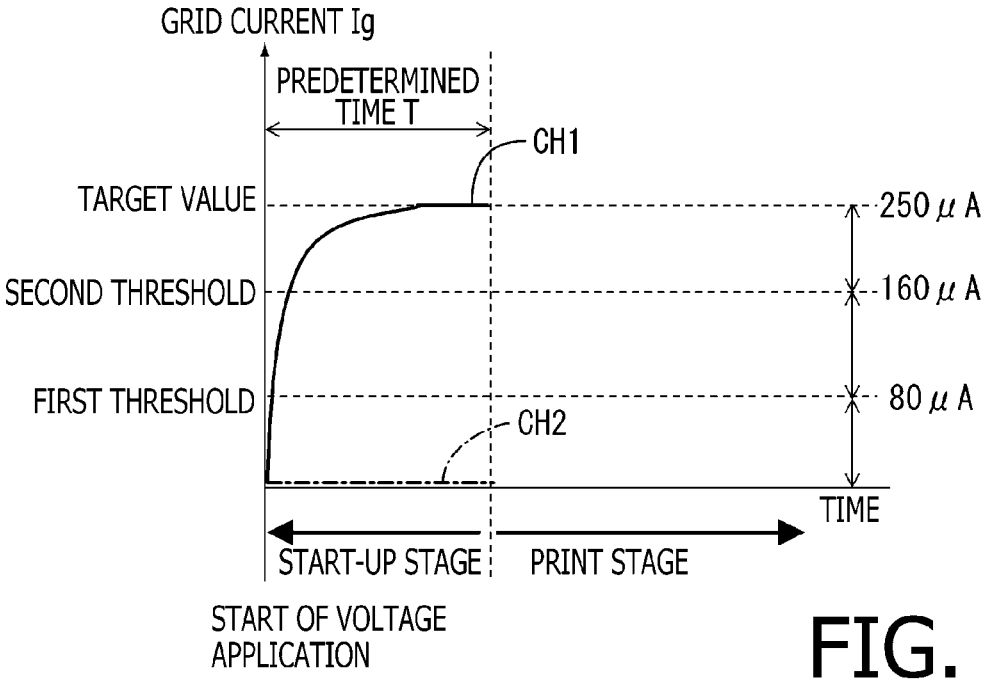

FIG. 7 is a graph illustrating transition of a grid current of each channel.

Figure 8:
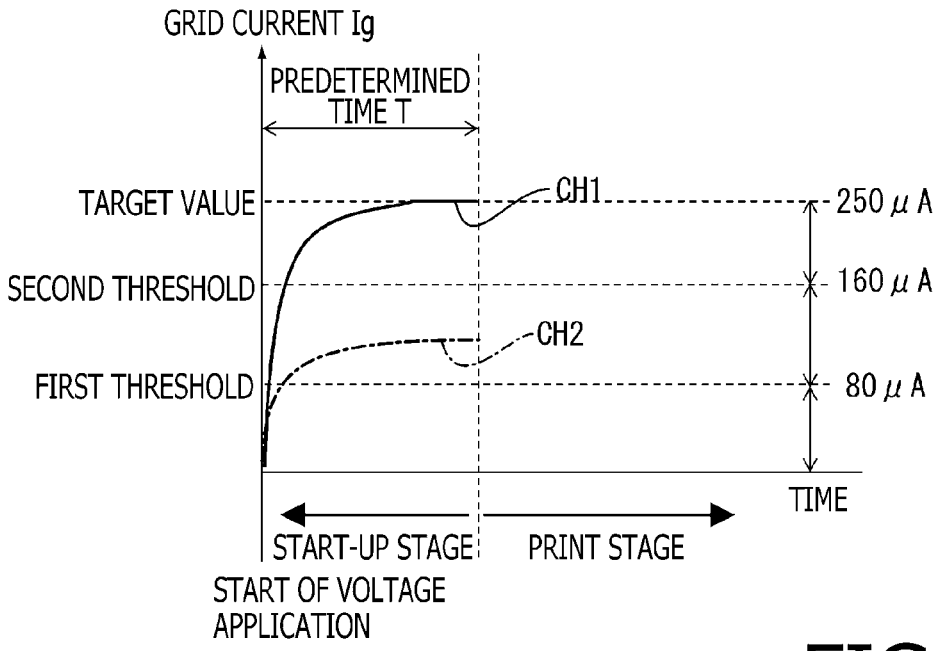

FIG. 8 is a graph illustrating transition of a grid current of each channel.

Figure 9:
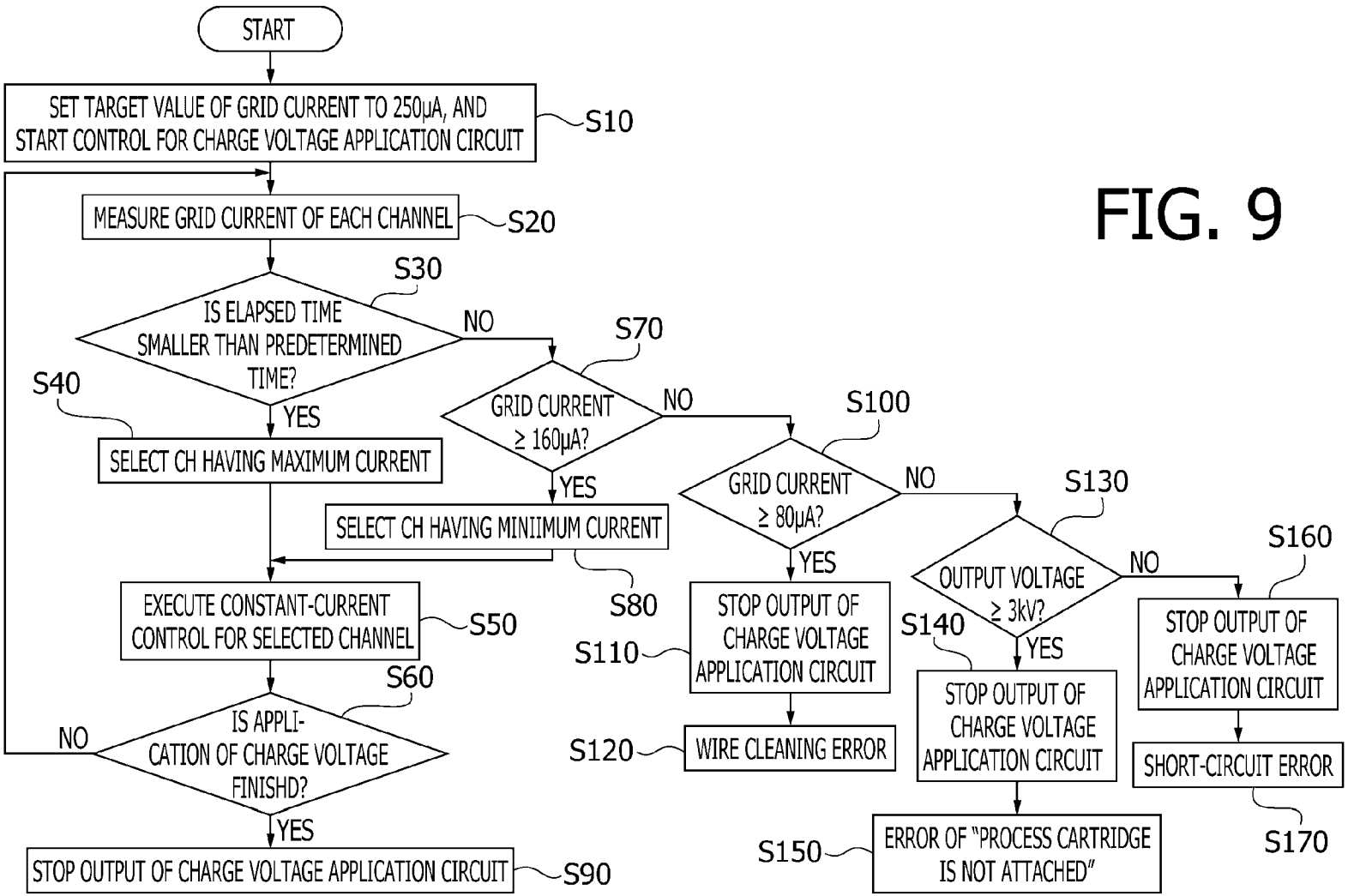

FIG. 9 is a flowchart illustrating a control flow for a high voltage power supply.

Figure 10:
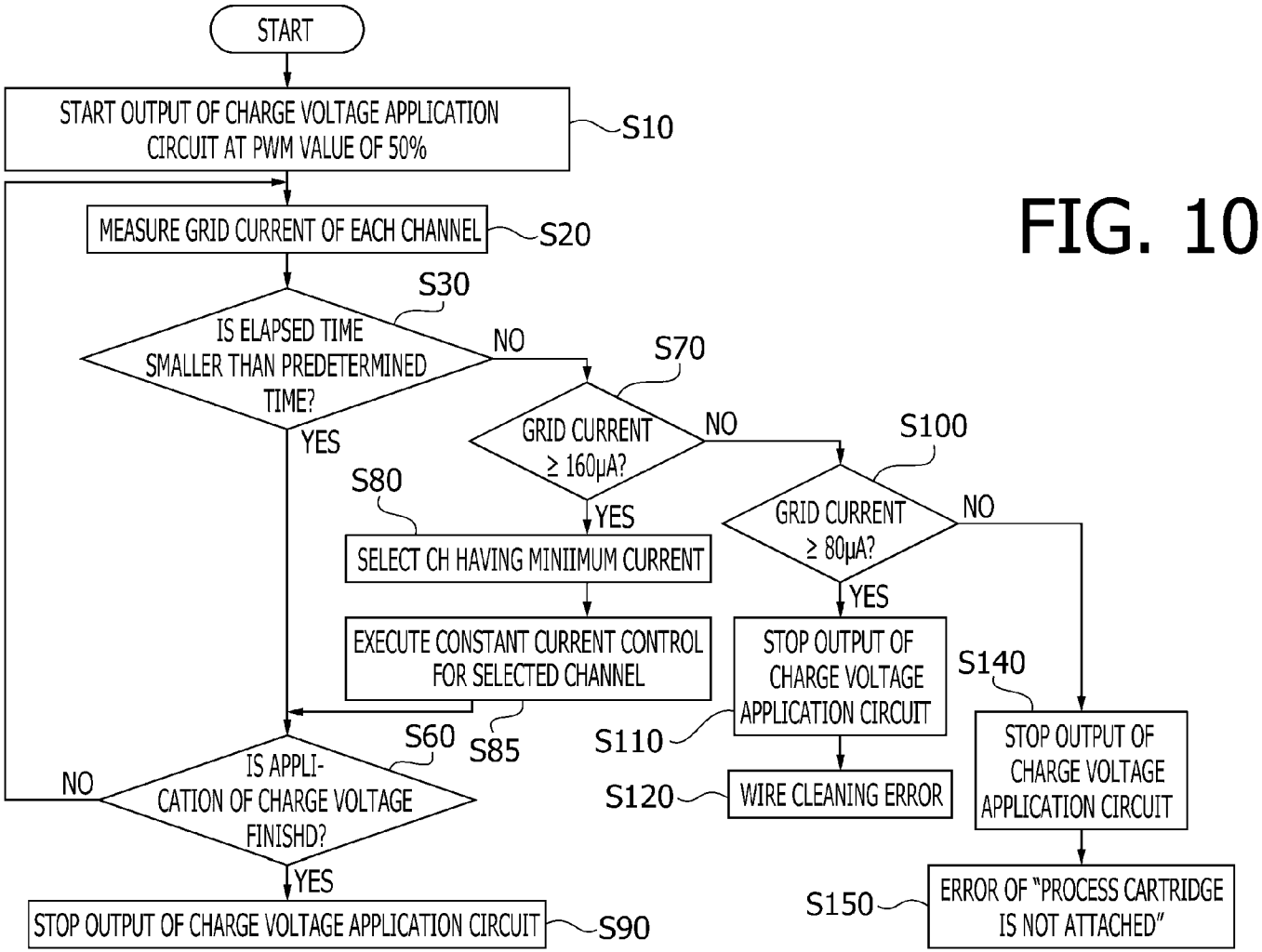

FIG. 10 is a flowchart illustrating a control flow for a high voltage power supply according to a second embodiment.

Figure 11:
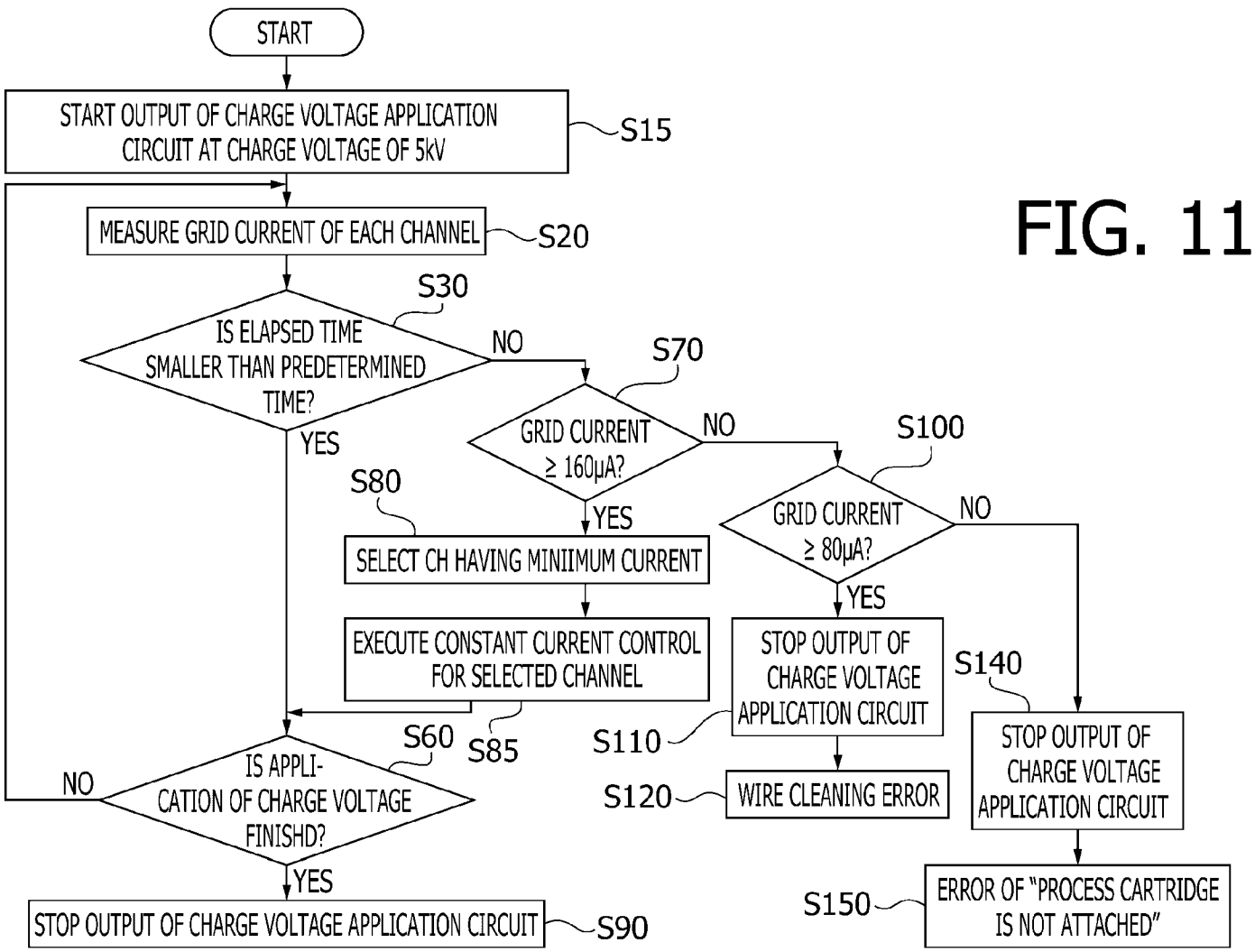

FIG. 11 is a flowchart illustrating a control flow for a high voltage power supply according to a third embodiment.

Figure 12:
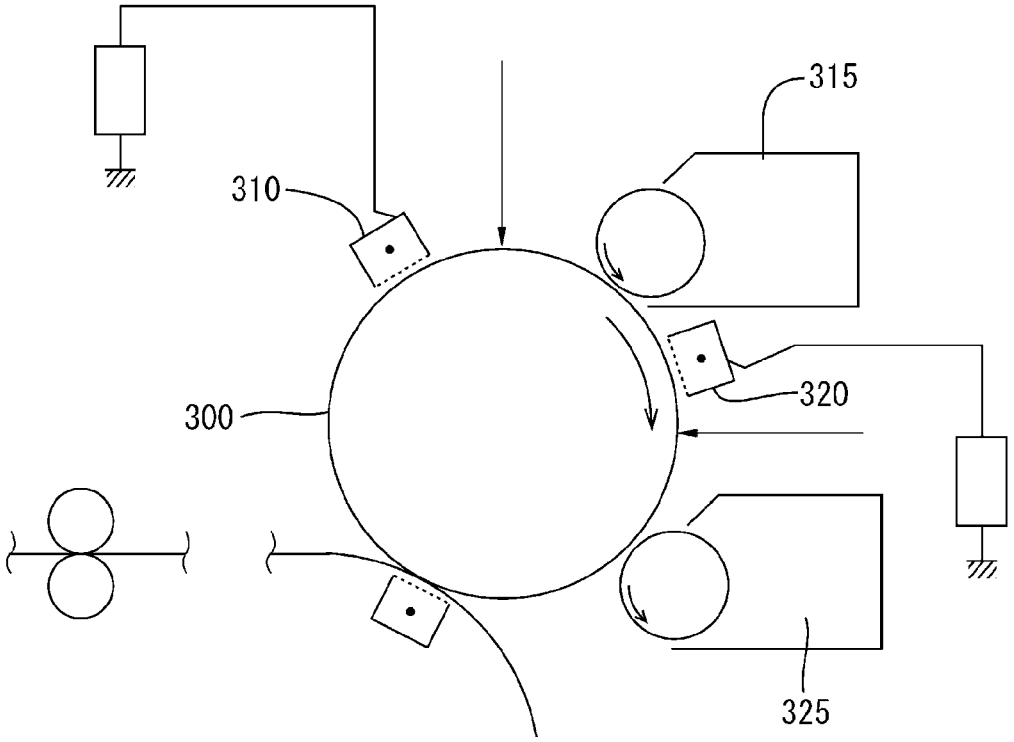

FIG. 12 is schematically illustrates another example of a configuration of a printer.

DETAILED DESCRIPTION

First Embodiment

Hereafter, a first embodiment according to the invention will be described with reference to FIGS. 1 to 9.

1. Overall Configuration of Printer

In the following explanations, when a component is separately explained for each color, a suffix B (black), Y (yellow), M (magenta) or C (cyan) is added to a reference symbol of each component.

Figure 1:
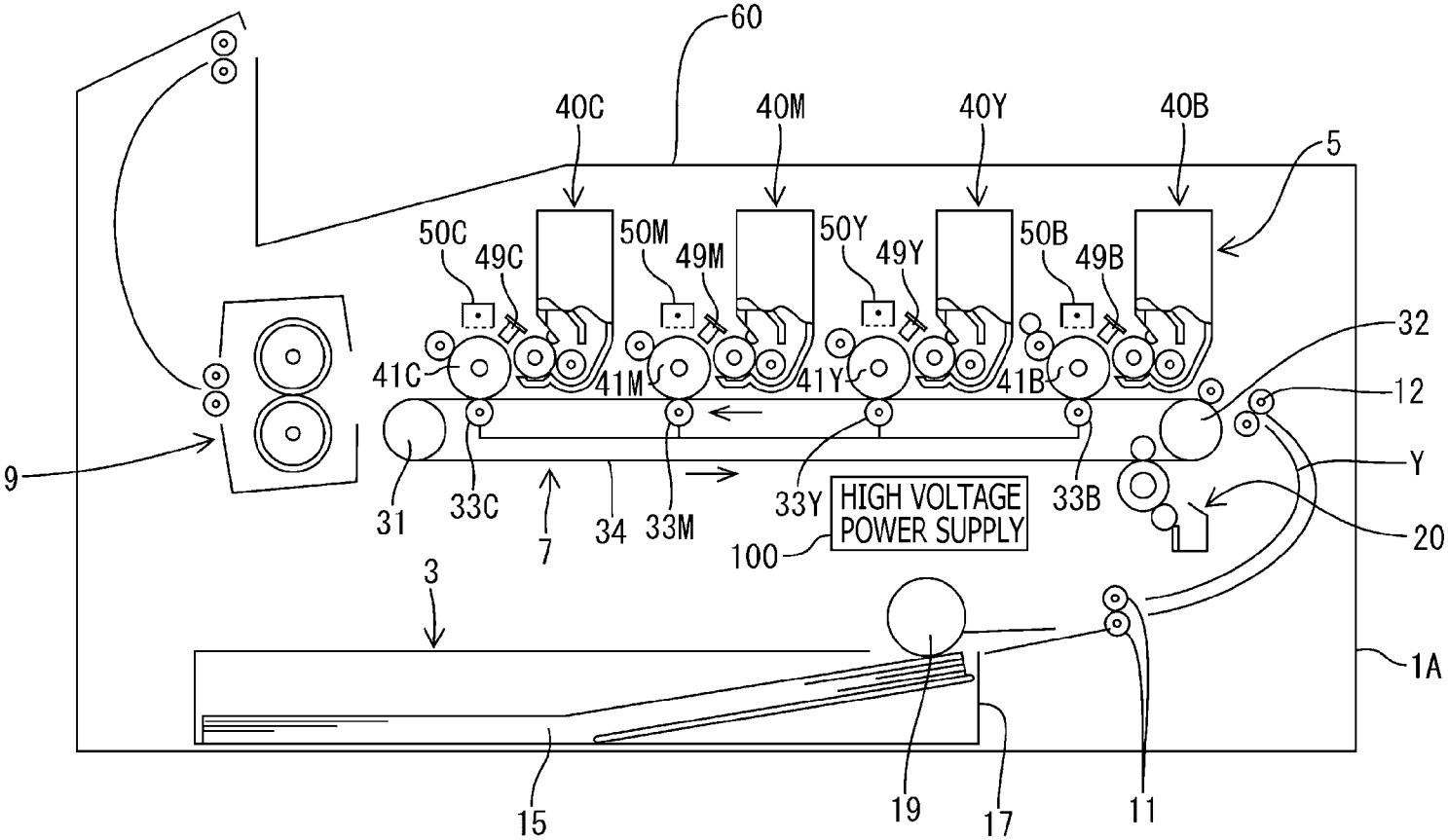
FIG. 1 is a cross sectional view generally illustrating an internal configuration of a printer according to an embodiment.
Figure 2:
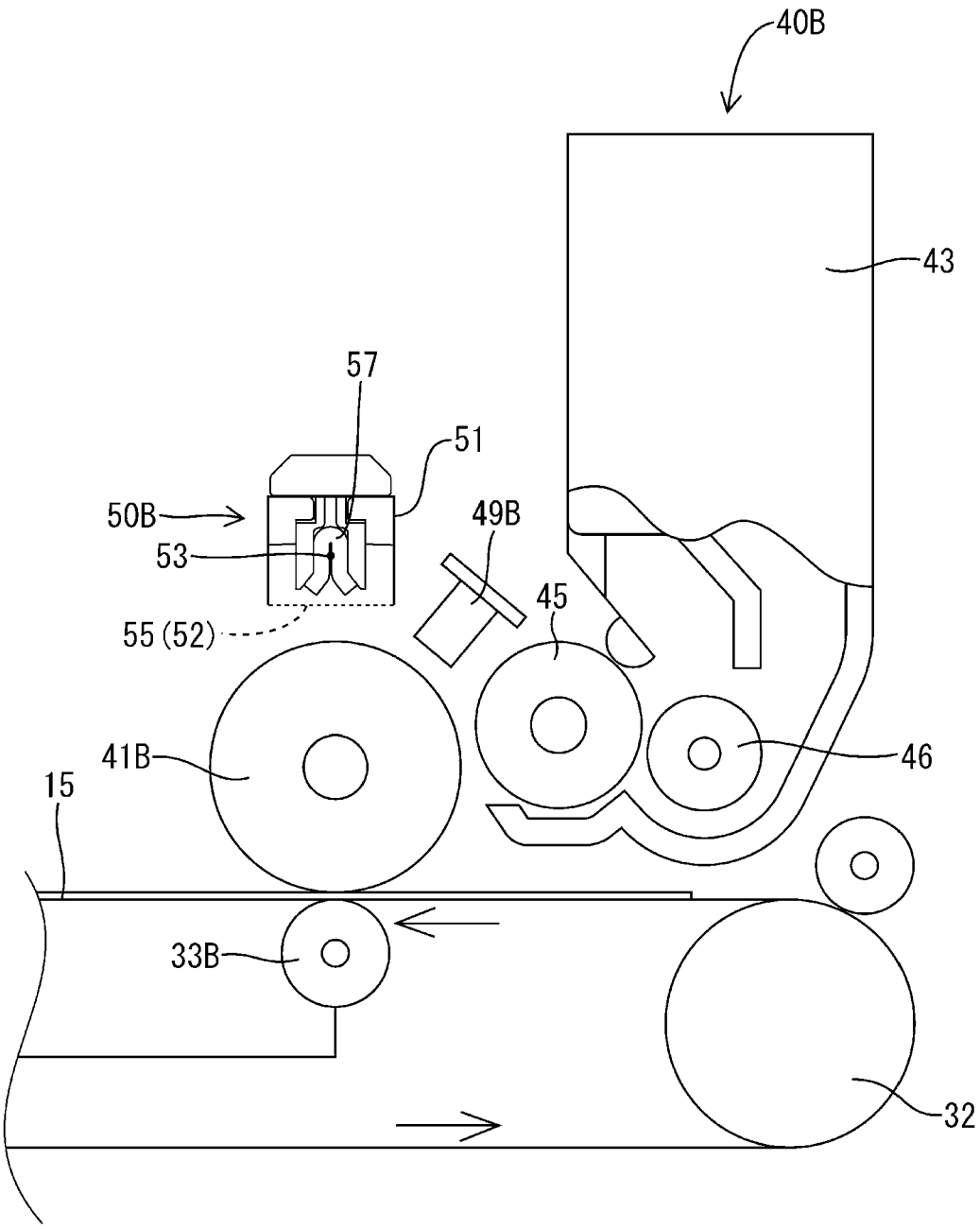
FIG. 2 is a cross sectional view generally illustrating a internal configuration of the printer around a process cartridge for black.

As shown in FIG. 1, the printer 1 includes a paper supply unit 3, an image formation unit 5, a conveying mechanism 7, a fixing unit 9, a belt cleaning mechanism 20 and a high voltage power supply 100. The paper supply unit 3 is provided at a lowermost position in the printer 1, and includes a tray 17 storing sheet-like medium 15 (e.g., a sheet of paper or an OHP sheet), and a pick-up roller 19. The sheet-like medium 15 stored in the tray 17 is picked up one by one by the pick-up roller 19, and is conveyed to the conveying mechanism 7 via a conveying roller 11 and a registration roller 12.

The conveying mechanism 7 is configured to convey the sheet-like medium 15, and is provided on the upper side of the paper supply unit 3 in the printer 1. The conveying mechanism 7 includes a drive roller 31, a driven roller 32 and a belt 34. The belt 34 is provided to extend between the drive roller 31 and the driven roller 32. When the drive roller 31 rotates, a surface of the belt 34 facing photosensitive drums 41B, 41Y, 41M and 41C moves from the right side to the left side in FIG. 1. As a result, the sheet-like medium 15 supplied from the registration roller 12 is conveyed to a position under the image formation unit 5.

The belt 34 is provided with four transfer rollers 33B, 33Y, 33M and 33C respectively corresponding to the four photosensitive drums 41B, 41Y, 41M and 41C. The transfer rollers 33 are arranged at positions respectively facing the photosensitive drums 41B, 41Y, 41M and 41C while sandwiching the belt 34 therebetween.

The image formation unit 5 includes four process cartridges 40B, 40Y, 40M and 40C and four exposure units 49B, 49Y, 49M and 49C. The process cartridges 40B, 40Y, 40M and 40C are arranged in a line along a conveying direction of the sheet-like medium 15 (i.e., the left and right direction in FIG. 1).

The process cartridges 40 have the same configuration. Each process cartridge 40 includes the photosensitive drum (41B, 41Y, 41M or 41C) which is a photosensitive body for a corresponding color, a toner case 43 storing toner which is a developer for a corresponding color, a developer roller 45 and the charger (50B, 50Y, 50M or 50C).

Each photosensitive drum (41B, 41Y, 41M or 41C) is configured to have a photosensitive layer having a positive electrostatic property on a substrate made of, for example, aluminum. In this configuration, the substrate made of aluminum is connected to the ground of the printer 1.

The development roller 45 is provided to face a supply roller 46 under the toner case 43. The development roller 45 serves to positively charge the toner by friction caused by rotation when the toner passes through a position between the development roller 45 and the supply roller 46, and to supply the toner to the photosensitive drum (41B, 41Y, 41M or 41C) as a thin uniform layer.

Each of the chargers 50B, 50Y, 50M and 50C is a scorotron charger, and includes a shield case 51, a wire 53 and a grid electrode 55 made of metal. The shield case 51 has a shape of a long square tube extending in a rotation axis direction of the photosensitive drum 41. In the shield case 51, a side facing the photosensitive drum 441 is opened as a discharge opening 52.

The wire 53 is made of, for example, a tungsten wire. The wire 53 is provided to extend in the rotation axis direction (the left and right direction in FIG. 3) in the shield case 51, and is applied a high voltage of 5 kV to 8 kV from a charge voltage application circuit 200 which is described later. Through application of the high voltage, the wire 53 causes corona discharge in the shield case 51. Ions caused by the corona discharge flow, as a discharge current, from the discharge opening 52 to the photosensitive drum 41 side, and thereby the surface of the photosensitive drum 41 is charged positively and uniformly.

To the discharge opening 52 of the shield case 51, the plate-like grind electrode 55 having slits and holes is attached. By applying a voltage to the grid electrode 55 and controlling the applied voltage, it becomes possible to control the charge voltage of the photosensitive drum 41.

A wire cleaner 57 is provided for each of the chargers 50B, 50Y, 50M and 50C. The wire cleaner 57 is configured to be able to freely slide along the wire 53. By moving the wire cleaner 57 to reciprocate along the wire 53 through operation by an operator, dust on the wire 53 can be removed. The exposure unit (50B, 50Y, 50M and 50C) includes a plurality of light emitting devices (e.g., LEDs or laser sources) arranged in a line along the rotation axis direction of the photosensitive drum (41B, 41Y, 41M or 41C). By emitting light in accordance with image data externally input, the exposure unit 49 serves to form an electrostatic latent image on the surface of the photosensitive drum (41B, 41Y, 41M or 41C).

A sequence of image formation process by the laser printer 1 described above is simply explained as follows. When the printer 1 receives print data D from a host apparatus (see FIG. 4), a print process is started. The surface of each of the photosensitive drums 41B, 41Y, 41M and 41C is charged positively and uniformly by the charger (50B, 50Y, 50M or 50C). Then, the laser light is emitted to the photosensitive drums 41B, 41Y, 41M and 41C from the respective exposure units 49. As a result, electrostatic latent images corresponding to the print data are respectively formed on the photosensitive drums 41B, 41Y, 41M and 41C. That is, on the surface of the photosensitive drum (41B, 41Y, 41M or 41C) charged positively and uniformly, a potential of a portion irradiated with the laser light decreases.

By rotation of the development roller 45, the toner which is held on the development roller 45 and changed positively is supplied to the electrostatic latent image formed on the photosensitive drum 41 (41B, 41Y, 41M or 41C). As a result, the electrostatic latent image on the photosensitive drum 41 (41B, 41Y, 41M or 41C) is visualized, and a toner image by reversal development is formed on the surface of the photosensitive drum 41 (41B, 41Y, 41M or 41C).

Concurrently with the above described process for forming the toner image, a process in which the sheet-like medium 15 is conveyed is performed. That is, by rotation of the pick-up roller 19, the sheet-like medium 15 is sent out from the tray 17 to a paper conveying path Y. The sheet-like medium 15 sent out to the paper conveying path Y is conveyed to a transfer position (where the photosensitive drum 41 and the transfer roller 33 contact with each other).

When the sheet-like medium 15 passes the transfer position, the toner images of the respective colors held on the photosensitive drums 41 are sequentially transferred to the sheet-like medium 15 to be overlapped with each other. Thus, a color toner image (a developer image) is formed on the sheet-like medium 15. Then, when the sheet-like medium 15 passes the fixing unit 9 provided on the rear side of the belt 34, the transferred toner image (developer image) is heat-fixed and is discharged on a discharge tray 60.

2. Configuration of High Voltage Power Supply

As shown in FIG. 5, the high voltage power supply 100 includes the charge voltage application circuit 200, a PWM signal smoothing circuit 210, a charge voltage detection circuit 240, constant voltage circuits 250B, 250Y, 250M and 250C, grid current detection units 260B, 260Y, 260M and 260C, and a control unit 110.

The PWM signal smoothing circuit 210 is an integration circuit including a resistance and a capacitor. The PWM signal smoothing circuit 210 smoothes a PWM signal S1 outputted from a PWM port P0 of the control unit 110, and outputs the smoothed signal to a base of a transistor Tr1 provided in the charge voltage application circuit 200.

The charge voltage application circuit 200 serves to generate a high voltage of approximately 6 kV to 8 kV from the input voltage of DC24V, and to apply the high voltage to each charger 50. In this embodiment, the charge voltage application circuit 200 employs a self-excitation flyback converter (RCC). The charge voltage application circuit 200 includes a transformer 201, a smoothing circuit 203 provided on the secondary side of the transformer 201, the transistor Tr1 provided on the primary side of the transformer 201, and a feedback coil 205.

The transistor Tr1 serves to perform switching of the transformer 201, and an emitter thereof is connected to the ground, and a collector thereof is connected to a primary side winding of the transformer 201. To the base of the transistor Tr1, the PWM signal smoothing circuit 201 is connected via the feedback coil 205.

To an output line Lo of the charge voltage application circuit 200, the wires 53 of the chargers 50B, 50Y, 50M and 50C are connected in common. With this configuration, the output voltage Vo of the charge voltage application circuit 200 is applied to the wires 53 of the chargers 50B, 50Y, 50M and 50C.

The charge voltage detection circuit 240 detects the output voltage Vo of the charge voltage application circuit 200, and includes an auxiliary winding 241 provided on the primary side of the transformer 201, and an integration circuit 243 having a resistance and a capacitor. The charge voltage detection circuit 240 is connected to an A-D port A0 of the control unit 110 so that data of the output voltage Vo of the charge voltage application circuit 200 is input to the control unit 110.

As shown in FIG. 5, in this embodiment, connection lines L1 to L4 are provided respectively for the chargers 50B, 50Y, 50M and 50C, and the grid electrodes 55 of the chargers 50B, 50Y, 50M and 50C are connected to the ground via the lines L1 to L4. On each of the lines L1 to L4, the constant voltage circuit 250 and the grid current detection unit 260 are provided.

Each of the constant voltage circuits 250B, 250Y, 250M and 250C includes three zener diodes, and serves to keep the voltage of the grid electrode 55 of each of the chargers 50B, 50Y, 50M and 50C at the three-fold value of the breakdown voltage of a single zener diode (e.g., 250V×3).

The grid current detection circuits 260B, 260Y, 260M and 260Y respectively include resistances R1 to R4 which are sequentially connected to the constant voltage circuits 250B, 250Y, 250M and 250C, respectively. A connection point between the resistance (R1, R2, R3, R4) and the constant voltage circuit (250B, 250Y, 250M, 250C) is connected via a signal line to the A-D port (A1, A2, A3, A4) provided on the control unit 110. With this configuration, the voltage in proportional to the current flowing through the connection line (L1, L2, L3, L4) is input to the A-D port (A1, A2, A3, A4). Therefore, by reading the level of the input voltage of the A-D port (A1, A2, A3, A4), it is possible to detect the grid current Ig of the charger (50B, 50Y, 50NM, 50C).

The control unit 110 has the function of controlling the grid current Ig flowing through the grid electrode 55 of the charger 50, and the function of making a judgment on whether the process cartridge is attached when the high voltage power supply 100 is started up. The control unit 110 includes a PWM port P0 and five A-D ports A0 to A4.

Control of the grid current Ig is conducted by outputting the PWM signal S1 from the PWM port P0 and adjusting the output voltage Vo of the charge voltage application circuit 200.

The control unit 110 may be configured such that a CPU is embedded therein or may be formed as an ASIC (Application Specific Integrated Circuit). The control unit 110 includes a built-in non-volatile memory in which programs for control of the high voltage power supply 100 and various types of data for making a judgment on whether the process cartridge 40 is attached. The various types of data include data (a) to (c) indicated below.

(a) Data of a target value of the grid current Ig (250 μA)

(b) Data of a first threshold of the grid current Ig (80 μA)

(c) Data of a second threshold of the grid current Ig (160 μA)

The grid current Ig is approximately proportional to the discharge current flowing from the charger 50 to the photosensitive drum 41, and serves as an indicator for measuring the level of the discharge current flowing through the photosensitive drum 41. That is, if the grid current Ig is equal to 250 μA which is the target value, the discharge current flowing through the photosensitive drum 41 is a reference level which is a proper level concerning the charge amount of the photosensitive drum 41 to keep the image quality.

In the following explanations, channels mean the chargers 50B, 50Y, 50M and 50C. Specifically, the chargers 50B, 50Y, 50M and 50C are referred to as CH1, CH2, CH3 and CH4, respectively.

3. Judgment on Whether Process Cartridge 40 is Attached

The printer according to the embodiment has the function of judging whether the process cartridge 40 is attached. More specifically, in the case where the process cartridge 40 is attached, the grid current of approximately 250 μA flows through the grid electrode 55 of each of the chargers 50B, 50Y, 50M and 50C when a predetermined high voltage is applied to the wire 53 of each of the chargers 50B, 50Y, 50M and 50C (see FIG. 6).

On the other hand, when the process cartridge 40 of one of the four channels CH1 to CH4 is not attached, the grid current Ig does not flows through the channel CH which in not attached. For example, when the process cartridge 40Y of the channel CH2 is not attached, the level of the grid current Ig of the channel CH2 becomes almost zero (see FIG. 7).

Therefore, by measuring the grid current Ig of each channel when the predetermined high voltage is generated by the charge voltage application circuit 200 and thereby judging whether the grid current Ig flows for each of the channels, it is possible to make a judgment on whether the process cartridge 40 is attached.

The predetermined high voltage generated by the charge voltage application circuit 200 may be the voltage (7 kV to 8 kV) to be applied during image formation or may be the voltage (e.g., 5 kV) which is slightly lower than the voltage to be applied during image formation but is able to generate a detectable grid current Ig.

In the case where the charge voltage application circuit 200 is controlled to generate the high voltage larger than or equal to 5 kV, when the process cartridge 40 is attached to the printer 1, at least the grid current Ig larger than equal to 80 μA flows through the channel of the attached process cartridge 40. Therefore, in this embodiment, 80 μA is set as a threshold (the first threshold), and when the grid current Ig is smaller than 80 μA, it is judged that "the process cartridge 40 is not attached" excepting the following cases.

When the wire 53 is short-circuited, i.e., when the wire 53 is broken and contacts with the grid electrode 55, the voltage of the wire 53 of the charger is brought to the voltage level equal to the grid electrode 55, i.e., 800V to 900V. Similarly, the output voltage Vo of the charge voltage application circuit 200 is brought to 800V to 900V.

In this case, the voltage of each of the chargers 50B, 50Y, 50M and 50C connected in common to the charge voltage application circuit 200 decreases to 800V to 900V. Therefore, for example, when the wire 53 is short-circuited in the charger 50B, the chargers 50Y, 50M and 50C which are not short-circuited are brought to the state of not discharging. Therefore, in this case, the grid current Ig becomes almost zero, i.e., becomes smaller than 80 μA as in the case where the process cartridge 10 is not attached.

For this reason, in the printer 1, when the grid current Ig is smaller than 80 μA, the output voltage Vo of the charge voltage application circuit 200 is compared with 3 kV, i.e., a reference voltage. When the output voltage Vo of the charge voltage application circuit 200 is larger than or equal to 3 kV, it is judged that "the process cartridge 40 is not attached" (see S150 which is described later). When the output voltage Vo of the charge voltage application circuit 200 is smaller than 3 kV, it is judged that "the process cartridge 40 is attached" (see step S170 which is described later). Specifically, with respect to the channel CH of which grid current Ig is the maximum, it is judged that the wire 53 of the charger 50 is short-circuited.

Furthermore, in the printer 1, the second threshold (160 μA) is also used as the threshold of the grid current Ig, in addition to the above described first threshold (80 μA). The second threshold of 160 μA is the threshold for judging a dirty state of the wire 53. That is, when the wire 53 of the charger 50 becomes larger, the resistance of the wire 53 increases accordingly. Therefore, the level of the grid current Ig flowing through the charger 50 decreases from the target value of 250 μA. For example, when the channel CH2 is dirty, the level of the grid current Ig of the channel CH2 decreases to the level approximately equal to the half of the target value of 250 μA (see FIG. 8).

For this reason, in the printer 1, the grid current Ig of each charger is measured by each grid current detection unit 260 when the predetermined high voltage is generated by the charge voltage application circuit 200. When the grid current Ig is 80 μA to 160 μA, it is judged that the wire 53 of the channel is dirty (see S120 which is described later).

4. Control Flow

Hereafter, a control flow for the high voltage power supply 100 to be executed by the control unit 110 is explained with reference to FIG. 9. As shown in FIG. 4, when print data D is outputted from a host apparatus, such as a host computer, the print data D is received by the printer 1 via an interface IF. Then, a print process start command is sent to the control unit 110 of the high voltage power supply 100 from a main control unit 80 which totally controls the printer 1.

As a result, the control unit 110 executes the control flow of the high voltage power supply 100 shown in FIG. 9. The control flow of the high voltage power supply 100 is divided into control in a start-up stage for starting up the high voltage power supply 100 and control in a print stage executed after starting up of the high voltage power supply 100. In the following, the control in the start-up stage is explained, and thereafter the control in the print stage is explained.

Control in Start-Up Stage

When the control flow of for the high voltage power supply 100 is started, the control unit 110 sets the target value of the grid current Ig to 250 μA. Then, the control unit 110 outputs the PWM signal S1 through the PWM port P0. As a result, the charge voltage application circuit 200 is started up, and the voltage is generated. Then, the control unit 110 monitors the grid current Ig by calculating the grid current Ig of each channel CH from the input voltage of each of the A-D ports A1 to A4 (S20).

Next, the control unit 110 judges whether a predetermined time T has elapsed from the start of the control flow. The predetermined time T is a time for starting up the high voltage power supply 100, and is approximately 100 mSEC to 200 mSEC. During a time period from the start of the control flow to the time at which the predetermined time T has elapsed, i.e., when the elapsed time is smaller than the predetermined time T, the judgment result in step S30 is YES.

When the judgment result in step S30 is YES, the process proceeds to step S40. In step S40, a process for selecting the channel CH having the maximum current is executed by the control unit 110. Specifically, the grid currents Ig of the channels are compared with each other, and the grid current Ig having the maximum value is selected. In the following, explanation is made assuming that the channel CH1 is selected.

When the channel CH having the maximum current is selected in step S40, the process proceeds to step S50. In step S50, the grid current Ig of the selected channel is subjected to constant current control. Since the channel CH1 is selected, the output voltage Vo of the charge voltage application circuit 200 is adjusted so that the grid current Ig of the channel all is brought to the target value of 250 μA.

Then, the process proceeds to step S60, and it is judged whether the process for applying the charge voltage has finished. If the process for applying the charge voltage has not finished, the judgment result of S60 becomes NO. When the judgment result of step S60 is NO, the process returns to step S20, and step S20 and steps following step S30 are executed.

During the time period from start of output by the charge voltage application circuit 200, steps S20, S30 (judgment result; YES), S40, S50 and S60 (judgment result; NO) are repeated.

With this configuration, until the predetermined time T has elapsed, the grid current Ig of "CH1" is subjected to the constant current control to be the target value of 250 μA. Therefore, as shown in FIG. 6, the grid current Ig of the channel CH1 becomes stable approximately at the target value of 250 μA within the predetermined time T, and the grid currents Ig of the other channels CH2 to CH4 become stable at the target value of 250 μA or the level smaller than 250 μA.

In FIG. 6, of the four channels CH, only the channel CH1 having the maximum grid current Ig and the channel CH2 having the minimum grid current Ig are shown, and the grid currents Ig of the other channels CH3 and CH4 are omitted.

When the predetermined time T has elapsed from start of output by the charge voltage application circuit 200, the judgment result in step S30 by the control unit 110 becomes NO. When the judgment result in step S30 is NO, the process proceeds to step S70.

In step S70, the control unit 110 judges whether the grid current Ig is larger than or equal to 160 μA. Specifically, the grid currents of the channels CH1 to CH4 are compared with the second threshold of 160 μA. When the grid currents of the channels CH1 to CH4 are larger than or equal to 160 μA, the judgment result becomes YES. On the other hand, when there is a channel having the grid current Ig smaller than 160 μA, the judgment result becomes NO. When the judgment result of step 370 is YES, the process proceeds to step S80. When the judgment result of step 370 is NO, the process proceeds to step S100. In the following, first, the explanation is given assuming that the judgment result of step S70 is YES. Then, the explanation is given for the case where the judgment result in step S70 is NO.

Control in Print Stage (The Case Where the Grid Current Ig is Larger Than or Equal to 160 μA at the Stage Where the Predetermined Time T has Elapsed)

When the judgment result of step S70 is YES, the process proceeds to step S80. In step S80, the control unit 100 executes a process for selecting the channel having the minimum current. Specifically, the grid currents Ig of the channels CH1 to CH4 are compared with each other, and the channel CH having the minimum grid current Ig is selected. In the following, explanation is given assuming that the "CH2" is selected.

When the channel CH having the minimum current is selected in step S80, the process proceeds to step S50. In step S50, the control unit 110 executes the constant current control for the grid current Ig of the selected channel. Since in this case the CH2 is selected, the control unit 110 adjusts the output voltage Vo of the charge voltage application circuit 200 so that the grid current of the CH2 becomes 250 μA.

Then, the process proceeds to step S60, and the process for applying the charge voltage is judged to be finished. When the process for applying the charge voltage is not finished, the judgment result in step S60 is NO. When the judgment result in step S60 is NO, the process returns to step S20, and step S20 and steps following S30 are executed.

When the grid current Ig is larger than or equal to 160 μA, the judgment result of step S70 becomes YES. Therefore, after the predetermined time T has elapsed, S20, S30 (judgment result: NO), S70 (judgment result: YES), S80, S50 and S60 (judgment result: NO) are repeated.

Therefore, after the predetermined time T has elapsed, the control unit 110 executes the constant current control so that the grid current of the channel having the minimum current (the "CH2" in this example) is kept at the target value of 250 μA. With this configuration, as shown in FIG. 6, the grid current Ig of the channel CH2 selected as the control target is brought to the stable state at approximately 250 μA, and the grid currents of the other channels CH1, CH3 and CH4 are brought to a stable state at the target value of 250 μA or the level larger than 250 μA.

As described above, in the printer 1, after the predetermined time T has elapsed, the channel having the minimum current is selected and is subjected to the constant current control at the target value of 250 μA. Therefore, the grid currents Ig of all the channels CH1 to CH4 become larger than or equal to the target value of 250 μA. Therefore, the discharge current larger than or equal to the reference level flows from each of the scorotron charger 50 to the photosensitive drum 41. Accordingly, the charge amount of the photosensitive drum 41 of each channel is brought to the proper level for maintaining the image quality.

Then, when the photosensitive drum 41 is brought to the state of being appropriately charged after the predetermined time T has elapsed, a print process for printing the print data on the sheet-like medium is executed. When the print process is finished, the process for applying the charged voltage is finished, and the judgment result of step S60 becomes YES. When the judgment result of S60 is YES, the process proceeds to step S90, and the process for stopping the charge voltage application circuit 200 is executed by the control unit 110. Thus, the control flow for the high voltage power supply 100 is finished.

The Case where the Grid Current Ig is Smaller than 160 μA when the Predetermined Time T has Elapsed Next, when the channel whose grid current Ig is smaller than 160 μA is found at the time when the predetermined time has elapsed from start of output by the charge voltage application circuit 200 (S70: NO), the process proceeds to step S100.

In step S100, the control unit 110 executes judges whether the grid current Ig of the channel for which the judgment result in step S70 was NO is larger than or equal to 80 μA. When the judgment result in step S100 is YES, the process proceeds to step S110.

In step S110, the control unit 110 executes a process for stopping the charge voltage application circuit 200. In step S120, the control unit 110 indicates a wire cleaning error. For example, in the case, a message indicating "please clean the wire" is displayed on a display (not shown) of the printer 1. By displaying such an error message, it becomes possible to urge a user to clean the wire.

On the other hand, when the judgment result of step S100 is NO, the process proceeds to step S130. In step S130, the control unit 110 judges whether the output voltage Vo of the charge voltage application circuit 200 (i.e., the charge voltage) is larger than or equal to 3 kV. Specifically, in this case the control unit 110 judges whether the output voltage Vo of the charge voltage application circuit 200 is larger than or equal to 3 kV based on the detection value of the charge voltage detection circuit 240.

When the output voltage Vo of the charge voltage application circuit 200 is larger than or equal to 3 kV, the process proceeds to step S140. In step S140, the control unit 110 stops the charge voltage application circuit 200. Then, the process proceeds to step S150. In step S150, the control unit 110 indicates a "no process cartridge error". For example, the control unit 110 displays an error message, the example, indicating that "process cartridge is not attached" on a display (not shown) of the printer 1. By displaying such an error message, it becomes possible to urge a user to attach the process cartridge 40.

On the other hand, when the output voltage Vo of the charge voltage application circuit 200 is smaller than 3 kV, the process proceeds to step S160. In step S160, the control unit 110 judges that the scorotron charger is short-circuited, and stops the charge voltage application circuit 200. Then, the process proceeds to step S170. In step S170, the control unit 110 indicates a short-circuit error. For example, in this case, an error message indicating "the scorotron charger is short-circuited" is displayed on a display (not shown) of the printer 1. By displaying such an error message, it becomes possible to urge a user to exchange the process cartridge (exchange the scorotron charger).

5. Advantages

As described above, the printer 1 according to the embodiment is able to judge whether the process cartridge is attached. Furthermore, the printer 1 is able to judge the short-circuit of the charger 50 and the dirty state of the wire 53. Since the printer 1 makes these three types of judgments based on the grid current and the output voltage Vo of the charge voltage application circuit 200, the number of components and the cost can be reduced in comparison with the case where a dedicated sensor is used to make these judgments.

Furthermore, in this embodiment, the judgment on whether the process cartridge is attached is executed at the timing when the process is switched from the start-up stage to the print stage. Since in such a case the judgment is made when the grid current Ig of each channel is brought to the stable state, it is possible to precisely execute the judgment on whether the process cartridge is attached. This also applies to the judgment regarding the short-circuited state of the charger and the dirty state of the wire.

The printer 1 according to the embodiment selects the channel CH having the maximum current is selected and executes the constant current control for the grid current in the start-up stage, and then selects the channel having the minimum current and executes the constant current control for the grid current Ig.

If control in the start-up stage is performed such that the printer according to the embodiment selects the channel CH having the minimum current and executes the constant-current control for the grid current Ig of the selected channel as in the case of the control in the print stage, when a channel for which it is judged that the process cartridge is not attached is found, the channel is selected as a control target. In this case, in order to increase the grid current Ig, the feedback control is performed so that output of the charge voltage application circuit 200 is increased, and as a result the output of the charge voltage application circuit 200 might exceed the upper limit.

In this regard, the printer 1 according to the embodiment is configured to select the channel CH having the maximum current and execute the constant-current control for the selected channel. Therefore, even when the channel whose process cartridge 40 is not attached is found, such a channel is not selected as a control target. Accordingly, it becomes possible to suppress increase of the output voltage Vo of the charge voltage application circuit 200 in the start-up stage.

Although, in the above described first embodiment, the judgment on the short-circuit and the dirty state of the wire is made in addition to the judgment on whether the process cartridge 40 is attached, the judgment on the short-circuit and the dirty state of the wire may be omitted (i.e., steps S100, S110, S120, S130, S160 and S170 may be omitted). In step S70, it is judged whether the grid current Ig is larger than or equal to the first threshold of 80 μA. When the grid current Ig is larger than or equal to 80 μA, the process proceeds to step S80, the channel having the minimum current is selected, and the constant-current control is performed for the selected channel CH (S50). On the other hand, when the grid current Ig is smaller than 80 μA, the process proceeds to step S140, the output of the charge voltage application circuit 200 is stopped, and the error indicating that the process cartridge is not attached is displayed (S150).

Second Embodiment

Hereafter, a second embodiment of the invention is explained with reference to FIG. 10. In the first embodiment, the channel CH having the maximum current is selected and the constant-current control (feedback control) of the grid current Ig is performed in the start-up stage. In the second embodiment, the charge voltage application circuit 200 is controlled while fixing an instruction value (i.e., feedforward control is performed). Specifically, the charge voltage application circuit 200 is controlled while fixing, at 50%, the PWM value of the PWM signal S1 to be outputted from the PWM port P0 of the control unit 110 (step S13 in FIG. 10).

By thus controlling the charge voltage application circuit 200 while fixing the instruction value, it becomes possible to suppress increase of the output voltage Vo of the charge voltage application circuit 200 even when the channel for which the process cartridge 40 is not attached exists, as in the case of the first embodiment. Regarding the method according to the second embodiment where the charge voltage application circuit 200 is controlled while fixing the instruction value (the feedforward control), the time period within which the output becomes stable is short in comparison with the feedback control. Therefore, it is possible to shorten the predetermined time T in comparison with the first embodiment.

Similarly to the first embodiment, the printer 1 according to the second embodiment judges whether the process cartridge 40 is attached by measuring the grid currents Ig of the channels CH1 to CH4 and comparing the first threshold with the grid currents Ig at the time of switching from the start-up stage to the print stage.

In the second embodiment, the control flow is configured by simplifying the control flow of the first embodiment, and the process (step S130 in the first embodiment) for judging whether the charger 50 is short-circuited and the process after detection of the short-circuit (steps S160 and S170 in the first embodiment) are omitted.

Although, in the second embodiment, the judgment on the dirty state of the wire 53 is performed in addition to the judgment on whether the process cartridge 40 is attached, the judgment on the dirty state of the wire 53 may be omitted (steps 100 to S120 are omitted). In this case, the control flow shown in FIG. 10 may be altered as follows. In step S70, it is judged whether the grid current Ig is larger than or equal to the first threshold of 80 μA. When the grid current Ig is larger than or equal to 80 μA, the process proceeds to step S80, the channel CH having the minimum current is selected, and the constant-current control is performed for the selected channel (S85). On the other hand, when the grid current Ig is smaller than 80 μA, the process proceeds to step S140, output of the charge voltage application circuit 200 is stopped, and then an error message indicating that the process cartridge 40 is not attached is displayed (S150).

Third Embodiment

In the following, the third embodiment of the invention is described with reference to FIG. 12. In the first embodiment, the channel CH having the maximum current is selected and the constant-current control (feedback control) of the grid current Ig is performed in the start-up stage. The third embodiment is different from the first embodiment in that, in the start-up stage, the constant-current control is performed for the charge voltage application circuit 200 so that the output voltage Vo becomes 5 kV. Specifically the constant-current control is performed for the charge voltage application circuit 200 based on the detected value of the charge voltage detection circuit 240.

By thus performing the constant-current control for the charge voltage application circuit 200 in the start-up stage, it is possible to suppress increase of the output voltage Vo of the charge voltage application circuit 200 even when the channel for which the process cartridge 40 is not attached is found, as in the case of the first embodiment.

Similarly to the first embodiment, the printer 1 according to the third embodiment makes a judgment on whether the process cartridge 40 is attached by measuring the grid currents Ig of the channels CH1 to CH4 and comparing the grid currents Ig with the first threshold.

In the third embodiment, the control flow is configured by simplifying the control flow of the first embodiment. In the third embodiment, the process for judging the short-circuit of the charger (S130 in the first embodiment) and the process after detection of the short-circuit (steps S160 and S170 in the first embodiment) are omitted.

Although, in the third embodiment, the judgment on the dirty state of the wire 53 is performed in addition to the judgment on whether the process cartridge 40 is attached, the judgment on the dirty state of the wire 53 may be omitted (steps 100 to S120 are omitted). In this case, the control flow shown in FIG. 11 may be altered as follows. In step S70, it is judged whether the grid current Ig is larger than or equal to the first threshold of 80 μA. When the grid current Ig is larger than or equal to 80 μA, the process proceeds to step S80, the channel CH having the minimum current is selected, and the constant-current control is performed for the selected channel (S85). On the other hand, when the grids current Ig is smaller than 80 μA, the process proceeds to step S140, output of the charge voltage application circuit 200 is stopped, and then an error message indicating that the process cartridge 40 is not attached is displayed (S150).

Although the present invention has been described in considerable detail with reference to certain preferred embodiments thereof, other embodiments are possible.

(1) In the above described first to third embodiments, the printer 1 is configured such that one charger 50 is associated with one photosensitive drum 41 (i.e., the photosensitive drums 41 are provided respectively for the colors). However, the present invention can be applied to a printer configured such that a plurality of chargers 310 and 320 are associated with one photosensitive drum 300 as shown in FIG. 12 (where after toner images of respective colors are overlaid on the photosensitive drum 300, the toner images are simultaneously transferred to the sheet-like medium). In FIG. 12, a component assigned a reference number 315 is a process cartridge (developing unit) associated with the charger 310, and a component assigned a reference number 325 is a process cartridge associated with the charger 320.

(2) In the first to third embodiments, the grid current detection units 260B, 260Y, 260M and 260C are provided respectively for the channels CH1 to CH45. However, a common grid current detection unit may be shared between the channels. In this case, the grid currents of the channels may be detected in a time division manner.

(3) In the first to third embodiments, the process cartridge 40 is configured to include the toner case 43, the development roller 45 and hr charger 50. However, it should be understood that it is sufficient for the process cartridge to include at least the charger 50. As the charger 50, a corotron charger may be used in place of the scorotron charger.

(4) In the above described first to third embodiments, whether the process cartridge is attached and the dirty state of the wire are judged by comparing the grid current Ig of each channel with the first threshold and the second threshold. In the first to third embodiments, the target value of the grid current Ig is set to 250 μA, the first threshold is set to 80 μA, and the second threshold is set to 160 μA. However, it should be understood that these values are examples, and the numerical values may be determined by considering the electric property of the printer 1.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

What is claimed is:

1. An image forming apparatus, comprising:

a plurality of process cartridges;

a plurality of chargers respectively associated with the plurality of process cartridges;

a charge voltage application circuit configured to be connected to each of the plurality of chargers and configured to apply a predetermined voltage to each of the plurality of chargers;

a current detection device configured to detect current flowing through each of the plurality of chargers; and a controller, wherein the controller is configured to operate, for a predetermined time period from start-up, to control the voltage of the charge voltage application circuit so that a maximum current value of the current flowing through each of the plurality of chargers becomes a predetermined target value;

wherein, after the predetermined time period has elapsed from start-up, the controller compares the current flowing through each of the plurality of chargers and detected by the current detection device with a first threshold and determines whether any of the currents detected by the current detection device is less than the first threshold; and in response to a determination that at least one current is less than the first threshold, the controller judges that at least one process cartridge is not attached to the image forming apparatus.

2. The image forming apparatus according to claim 1, wherein the controller controls the voltage of the charge voltage application circuit so that a minimum current value of the currents detected by the current detection device becomes a predetermined target value when the minimum current value is greater than or equal to a second threshold in a state where the charge voltage application circuit generates the predetermined voltage.

3. The image forming apparatus according to claim 1, wherein the controller provides an indication prompting attaching the process cartridge when the current detected by the current detection device is less than the first threshold.

4. The image forming apparatus according to claim 1, wherein the controller operates:

to control the voltage of the charge voltage application circuit so that a minimum current value becomes the predetermined target value when the minimum current value of the currents detected by the current detection device is greater than the first threshold.

5. The image forming apparatus according to claim 4, further comprising a voltage detection unit configured to detect an output voltage of the charge voltage application circuit, wherein the controller judges that the charger having the maximum current value is short-circuited when one of the currents detected by the current detection device is less than the first threshold and the output voltage detected by the voltage detection unit is less than a reference value.

6. The image forming apparatus according to claim 1, wherein the controller operates:

for a predetermined time period from start-up, to control the charge voltage application circuit while fixing an instruction value;

after the predetermined time period has elapsed from the start-up, to compare the currents detected by the current detection unit with the first threshold, and to judge that the process cartridge is not attached when the current smaller than the first threshold is detected; and to control the voltage of the charge voltage application circuit so that the minimum current value becomes a predetermined target value when the minimum current value of the currents detected by the current detection unit is larger than the first threshold.

7. The image forming apparatus according to claim 1, wherein the controller operates:

for a predetermined time period from start-up, to execute a constant voltage control for the charge voltage application circuit so that an output voltage of the charge voltage application circuit is kept constant;

after the predetermined time period has elapsed from the start-up, to compare the currents detected by the current detection device with the first threshold, and to judge that the process cartridge is not attached when the current detected by the current detection device is less than the first threshold; and to control the voltage of the charge voltage application circuit so that a minimum current value becomes a predetermined target value when the minimum current value of the currents detected by the current detection device is greater than the first threshold.

8. The image forming apparatus according to claim 1, wherein:

each of the plurality of chargers is a scorotron charger having a discharge wire and a grid electrode;

the current detection device is configured to detect a grid current flowing through the grid electrode of the scorotron charger; and the controller judges that the discharge wire is dirty when one of grid currents detected by the current detection device is greater than or equal to the first threshold and is less than a second threshold which is greater than the first threshold.

* * * * *